US005988940A

United States Patent [19]

Johansson

[11] Patent Number: 5,988,940

[45] Date of Patent: Nov. 23, 1999

[54] DEVICE FOR CLEANING THE ROLLER SURFACE OF A VIBRATING ROLLING MACHINE FOR COMPACTING MATERIALS

[75] Inventor: Lennart Johansson, Karlshamn, Sweden

[73] Assignee: Svedala Compaction Equipment AB, Karlskrona, Sweden

[21] Appl. No.: 09/188,322

[22] Filed: Nov. 10, 1998

[30] Foreign Application Priority Data

Nov. 10, 1997 [SE] Sweden ..... 9704107

[51] Int. Cl.[6] ..... E01C 19/22

[52] U.S. Cl. ..... 404/129; 15/256.51

[58] Field of Search ..... 404/129; 100/174; 118/261; 15/256.51

[56] References Cited

U.S. PATENT DOCUMENTS 1,942,655 1/1934 McCormick et al. ..... 404/129 X
3,802,339 4/1974 Andersson et al. .
4,040,762 8/1977 Nilsson .
5,222,828 6/1993 Magalski .
5,661,959 9/1997 Vargas ..... 404/129 X

FOREIGN PATENT DOCUMENTS 08165610 6/1996 Japan .

*Primary Examiner*—James A. Lisehora
*Attorney, Agent, or Firm*—Walter Ottesen

[57] ABSTRACT

The invention relates to a scraper device for static or vibratory rolling machines for compacting materials, primarily gravel, earth and asphalt. The scraper device includes a scraper element (6) which is designed to clean the surfaces of a roller cylinder of gravel, earth or asphalt adhering to the surfaces as the material is compacted. A spring (10) permits scraper elements to be easily lifted clear of the surfaces when cleaning of the latter is not required.

2 Claims, 3 Drawing Sheets

DEVICE FOR CLEANING THE ROLLER SURFACE OF A VIBRATING ROLLING MACHINE FOR COMPACTING MATERIALS

FIELD OF THE INVENTION

The invention relates to a device for static or vibratory rolling machines for compacting materials, primarily gravel, earth and asphalt. The device includes spring-loaded scrapers which clean the roller cylinder surfaces of gravel, earth or asphalt adhering to the surfaces as the material is compacted. The spring-loaded scrapers can easily be lifted clear of the surfaces when cleaning of the latter is not required.

BACKGROUND OF THE INVENTION

Earlier scraper devices used for this purpose are usually mounted permanently on the roller cylinder frame and must be adjusted with tools to ensure sufficient contact with the cylinder as the scrapers wear. Spring-loaded scrapers, such as the coil spring-loaded scraper described in Swedish Patent 337,387 already exist. However, this type of scraper is bulky and cannot be lifted clear of the roller cylinder surface when cleaning the scraper or when the scraper is not required to clean the surface.

SUMMARY OF THE INVENTION

It is an object of the invention to eliminate the disadvantages of known scraper devices by providing a dual-position scraper device. One position of the device is a working position in which the scraper is held in contact with the surface of the roller cylinder, and the other position is a rest position in which the scraper can be lifted manually completely clear of the cylinder surface. This is achieved by permitting the scraper device to pivot on pins attached to a mounting bracket bolted to the rolling cylinder frame and by providing a pair of operating springs (torsion springs) at each end of the scraper in such manner that the springs, when in the work position, press the scraper against the cylinder surface and, when in the rest position, hold the scraper clear of the cylinder surface against a mechanical stop. This is achieved by providing spring attachment studs on the scraper and a scraper mounting bracket in such manner that the springs snap through the mid-position in the manner of an over-center mechanism when the scraper is adjusted from one position to another.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
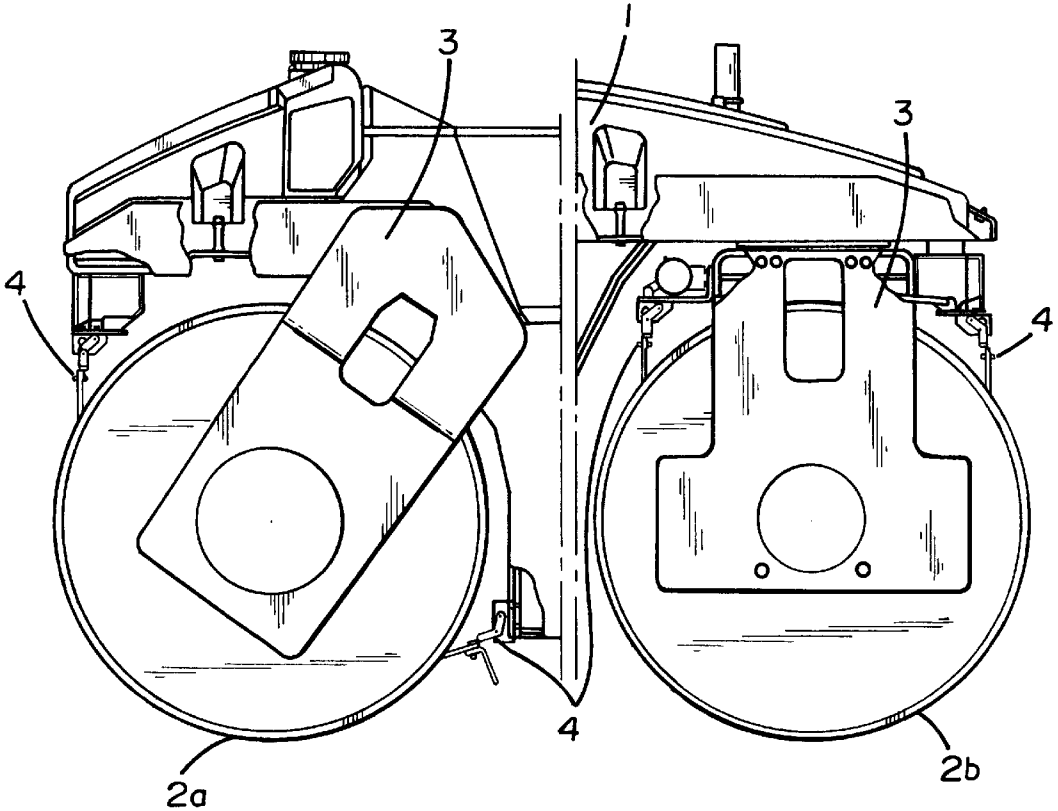
FIG. 1 is a side elevation view of the forward and rearward portions of a rolling machine showing the location of the scraper device of the invention thereon.

FIG. 1 shows a rolling machine 1 with the roller cylinders 2*a* and 2*b* supported in respective roller cylinder frames 3.

The scraper devices 4 are mounted in the roller cylinder frames 3 at opposite sides of the roller cylinders 2*a* and 2*b*, respectively.

Figure 2:
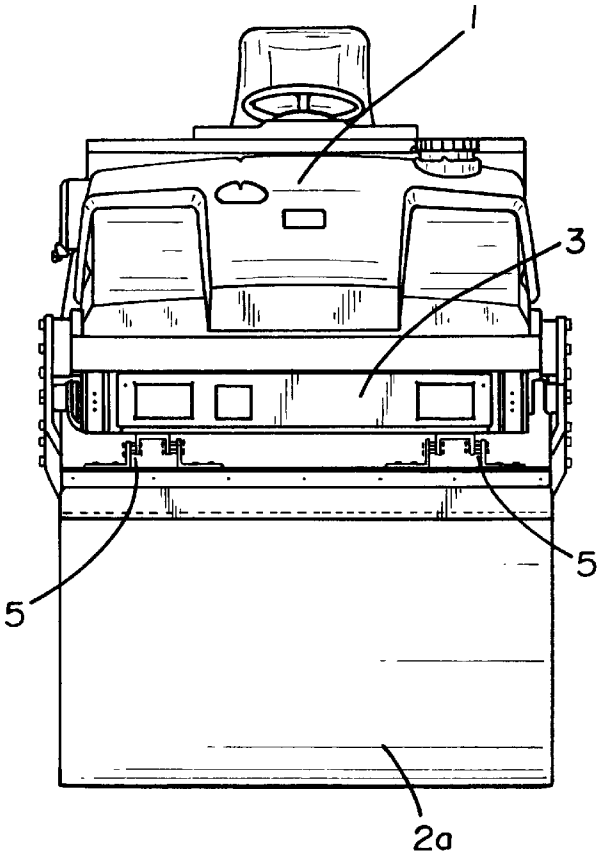
FIG. 2 is a front elevation view of the rolling machine shown in FIG. 1 again showing the scraper device according to an embodiment of the invention.

FIG. 2 shows the front scraper device 4 supported in a pivot mount on the roller cylinder frame 3 by operating spring devices 5.

Figure 3:
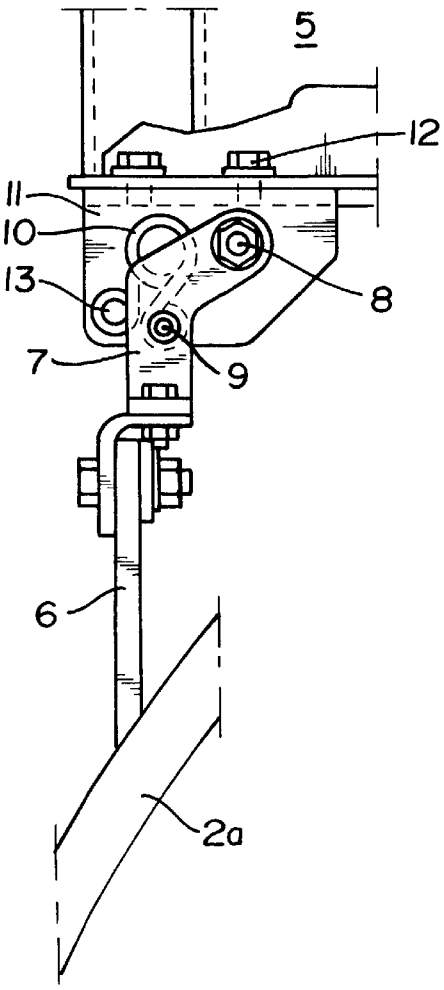
FIG. 3 is a detailed side view of the scraper and mounting arrangement i the work position.

In FIG. 3, the scraper 6, which may preferably be made of VULCOLANE, is shown bolted to the pivot arm 7, which is supported on the pivot pin 8 and provided with an attachment stud 9 for one leg of the operating spring 10. The pivot pin 8 is attached to the bracket 11 which, in turn, is attached to the roller cylinder frame 3 by a bolted joint 12. The bracket 11 is provided with elongated holes for the bolted joint 12 to permit the scraper device to be adjusted relative to the roller cylinder 2*a* as required as the scraper 6 becomes worn. The other legs of the operating spring are attached to the attachment stud 13 on the bracket 11.

Figure 4:
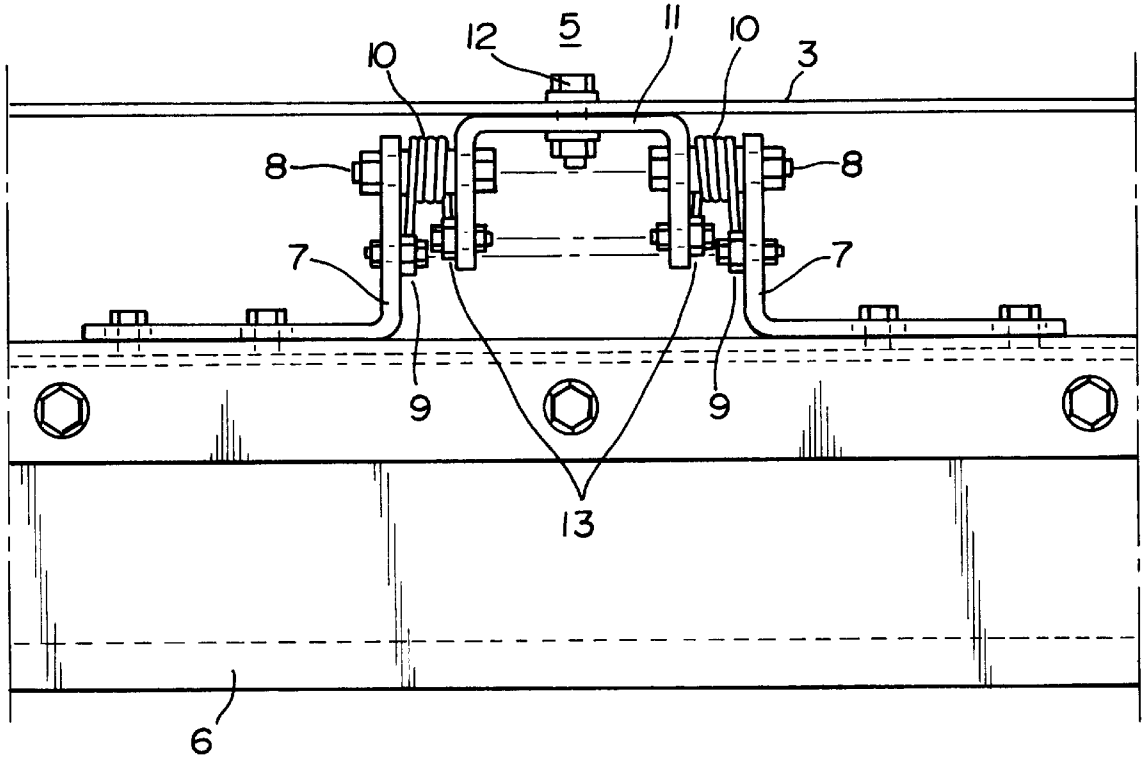
FIG. 4 is a front elevation view of the scraper and mounting arrangement shown in FIG. 3; and, FIG. 5 is a detailed view of the scraper in the rest position.

In the position shown in FIGS. 3 and 4, spring 10 presses the scraper 6 against the roller cylinder 2*a* because the attachment stud 9 is located below an imaginary line connecting the pivot pin 8 and the attachment stud 13.

Figure 5:
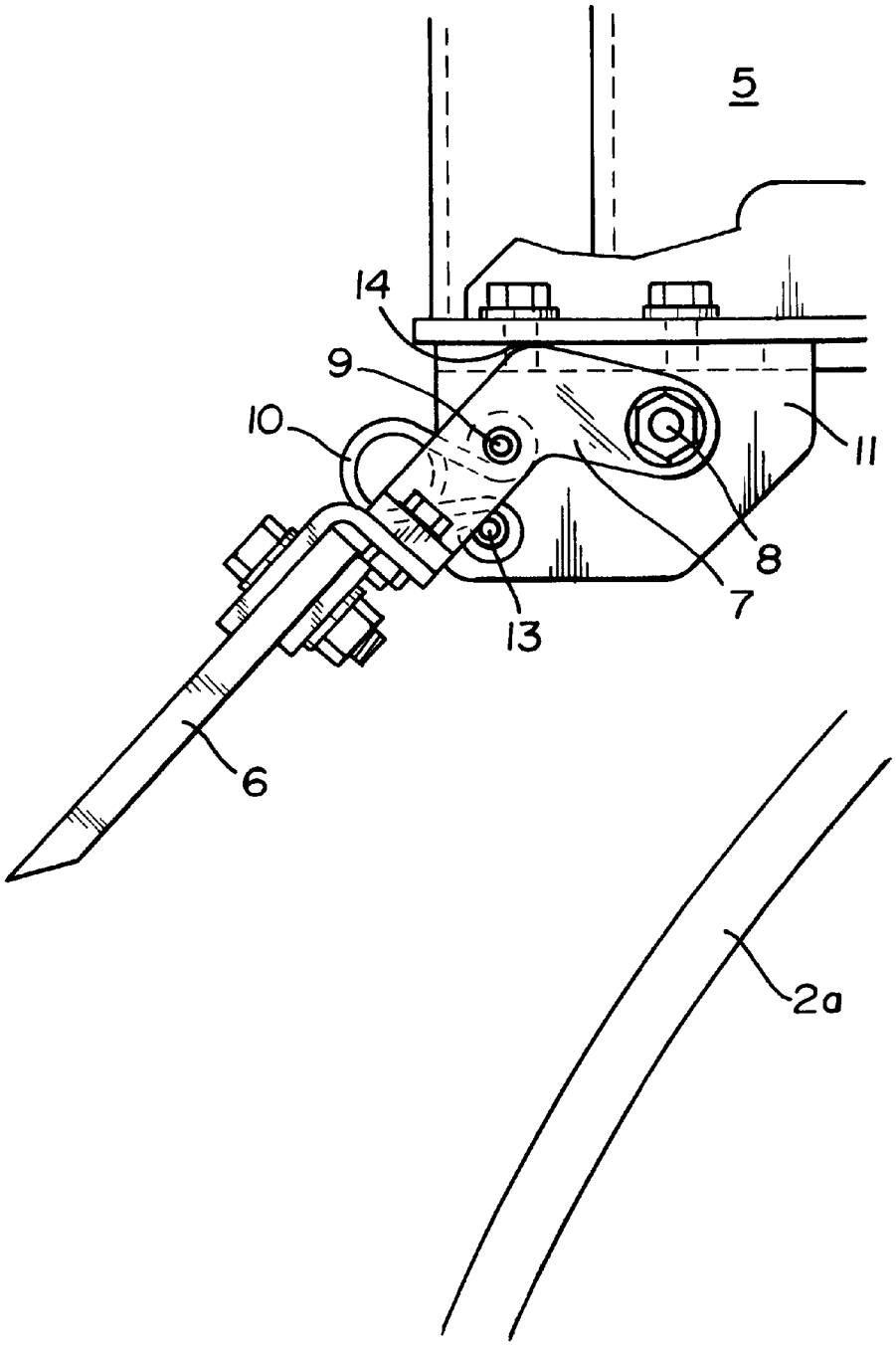

The spring 10 presses the scraper 6 into the rest position shown in FIG. 5 when the scraper 6 is manually lifted clear of the roller cylinder 2*a* so that the attachment stud 9 passes through the imaginary line joining the pivot pin 8 and the attachment stud 13.

FIG. 5 is a view of the operating spring assembly 5 with the scraper 6 in the rest position. Since the attachment stud 9 is now positioned above the imaginary line connecting the pivot pin 8 and the attachment stud 13, the spring 10 holds the scraper in the rest position, in which the knee of the pivot arm 7 is stopped by contact at point 14 on the frame 3.

The invention is not confined to the embodiment shown, but also includes scraper devices on rolling machines of other types, such as combi rollers and rubber-tired rollers, in which the actual scraper is provided with a profiled scraping edge to suit the object to be cleaned.

It is understood that the foregoing description is that of the preferred embodiments of the invention and that various changes and modifications may be made thereto without departing from the spirit and scope of the invention as defined in the appended claims.

What is claimed is:

1. A scraper device for a vibratory rolling machine for compacting materials such as gravel, earth and asphalt, the vibratory rolling machine including a frame and a roller rotatably mounted in said frame, the roller having a cylindrical surface on which residual compacting material adheres during operation of the vibratory rolling machine, the scraper device comprising:

a bracket connected to said frame;

a pivot arm;

a scraper element mounted on said pivot arm;

means for pivotally connecting said pivot arm to said bracket so as to permit said pivot arm to move between a work position wherein said scraper element is in contact engagement with said cylindrical surface to remove said residual material and a rest position wherein said scraper element is in spaced relationship to said cylindrical surface;

a first attachment stud mounted on said pivot arm and a second attachment stud mounted on said bracket;

an operating spring having a first end connected to said first attachment stud and a second end connected to said second attachment stud;

said operating spring being configured to apply a force to said first and second attachment studs;

said second attachment stud and said pivot means conjointly defining an imaginary line; and, said first attachment stud being located on said pivot arm so as to pass through said imaginary line when said scraper element is moved between said work position and said rest position causing the force applied by said first and second ends to reverse thereby resiliently biasing said pivot arm and said scraper element against said cylindrical surface in said work position and resiliently holding said pivot arm and said scraper element away from said cylindrical surface in said rest position.

2. The scraper device of claim 1, wherein said bracket has a slot formed therein; an adjustable bolt connecting said bracket to said frame; and, said slot being positioned vis-a-vis said roller so as to permit said bracket to shifted relative to said frame and said roller to compensate for wear on said scraper element.

* * * * *